US006776506B2

(12) United States Patent
Tseng

(10) Patent No.: US 6,776,506 B2
(45) Date of Patent: Aug. 17, 2004

(54) CONNECTOR FOR DECORATIVE LAMP RACKS

(76) Inventor: Wei-Jen Tseng, No. 50, Lane 118, Chin-Chu Rd., Hsinchu (TW)

( * ) Notice: Subject to any disclaimer, the term of this patent is extended or adjusted under 35 U.S.C. 154(b) by 0 days.

(21) Appl. No.: 10/279,793

(22) Filed: Oct. 25, 2002

(65) Prior Publication Data

US 2004/0080940 A1 Apr. 29, 2004

(51) Int. Cl.[7] ..... F21V 21/00
(52) U.S. Cl. ..... 362/249; 362/396; 362/250
(58) Field of Search ..... 362/249, 565, 362/566–567, 121–122, 162, 450, 506, 807, 238–239, 396, 250; 428/9; 260/419–422

(56) References Cited

U.S. PATENT DOCUMENTS 6,401,404 B1 * 6/2002 Fillipp et al. ..... 52/80.1

* cited by examiner

*Primary Examiner*—Stephen Husar
*Assistant Examiner*—Guiyoung Lee
(74) *Attorney, Agent, or Firm*—Rosenberg, Klein & Lee

(57) ABSTRACT

A connector for decorative lamp racks includes a band having a plurality of adjoined elements. Each of the elements has at least one edge flexibly connected to adjacent one of the elements and has an end defining a hole therein. The band is provided with a clasp for releasably joining ends of the band together after the band having been looped. The connector can connect the decorative lamp racks so as to form a stable frame.

11 Claims, 9 Drawing Sheets

CONNECTOR FOR DECORATIVE LAMP RACKS

BACKGROUND OF THE INVENTION

1. Field of the Invention

The present invention relates to a connector for decorative lamp racks and, more particularly, to a connector which can connect decorative lamp racks so as to form a stable frame.

2. Description of Related Art

Decorative lamps are one of the most traditional ornaments at Christmas Eve, for the glitter of them usually brings a cosy sensation against the cold winter night. Now such lamps are arranged in various patterns, and it becomes an important subject for the manufacturers to provide a means that can achieve an easy arrangement in a quick manner.

A foldable, star-like frame for such purpose is known. The frame includes a plurality of separate racks each having an upper leg and a lower leg. Because the upper legs and the lower legs of the racks are connected together by respective rings around them, the frame can be unfolded for used and folded for storage.

However, the resulting frame is not stable: it will collapse even without touching it.

Therefore, it is an objective of the invention to provide a connector for decorative lamp racks to mitigate and/or obviate the aforementioned problem.

SUMMARY OF THE INVENTION

The object of the present invention is to provide a connector which can connect decorative lamp racks so as to form a stable frame.

Other objects, advantages and novel features of the invention will become more apparent from the following detailed description when taken in conjunction with the accompanying drawings.

DETAILED DESCRIPTION OF THE PREFERRED EMBODIMENT

Figure 1:
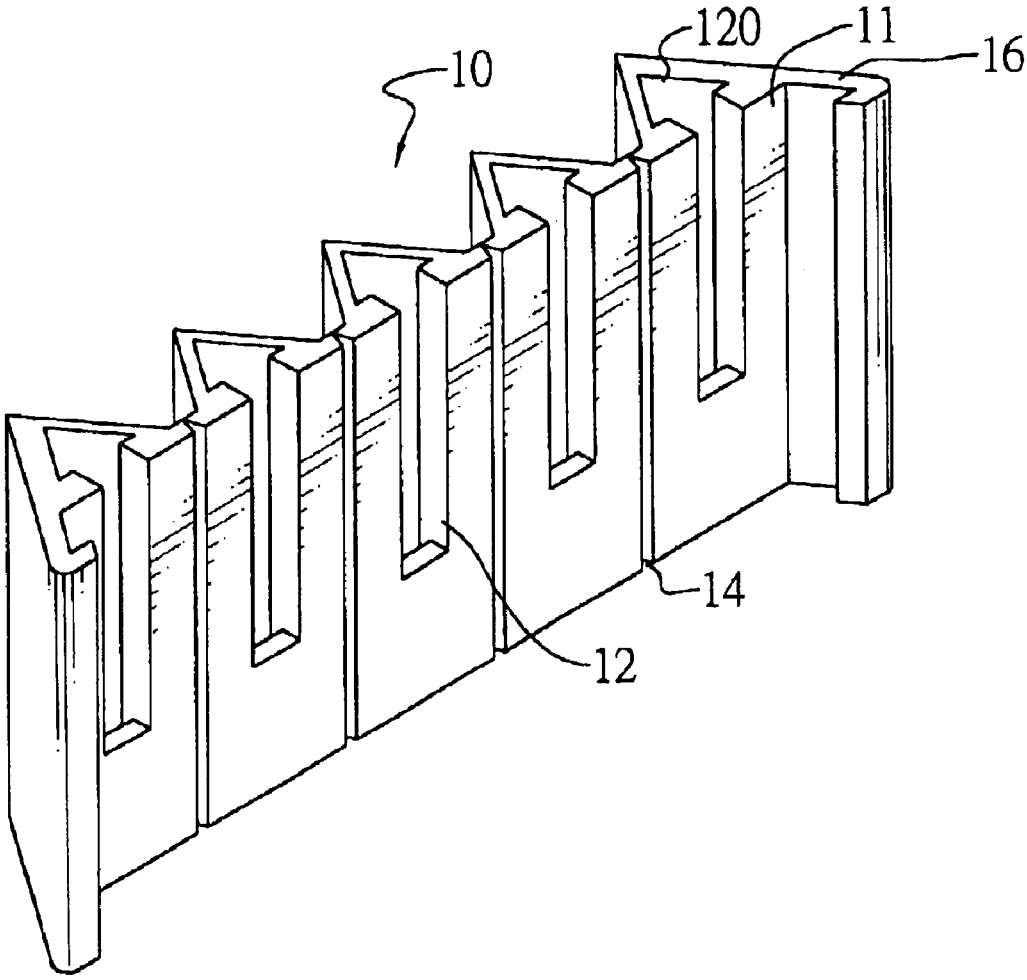
FIG. 1 is a perspective view of a band included in a first embodiment of a connector in accordance with the present invention.

Referring to FIG. 1, there is shown a first preferred embodiment of a connector in accordance with the present invention. The inventive connector includes a band (10) having a planar outer side and an indented inner side. In fact, the band (10) is made of a plurality of adjoined elements (11), each being shaped into a triangular prism or a truncated triangular prism on the indented inner side.

Each of the elements (11) has an end defining a hole (120) preferably with a slot portion (12) formed in the outer side of the band (10), and has at least one flexible edge (14) flexibly connected to adjacent one of the elements (11). The flexible connection between the elements (11) provides the band (10) with such a flexibility that the band (10) may be looped in a manner as shown in FIG. 2.

Additionally, the band (10) has a pair of hooked lips (16) extending from ends thereof. The two hooked lips (16) abut each other after the band (10) has been looped, as can be seen in FIG. 2.

Figure 2:
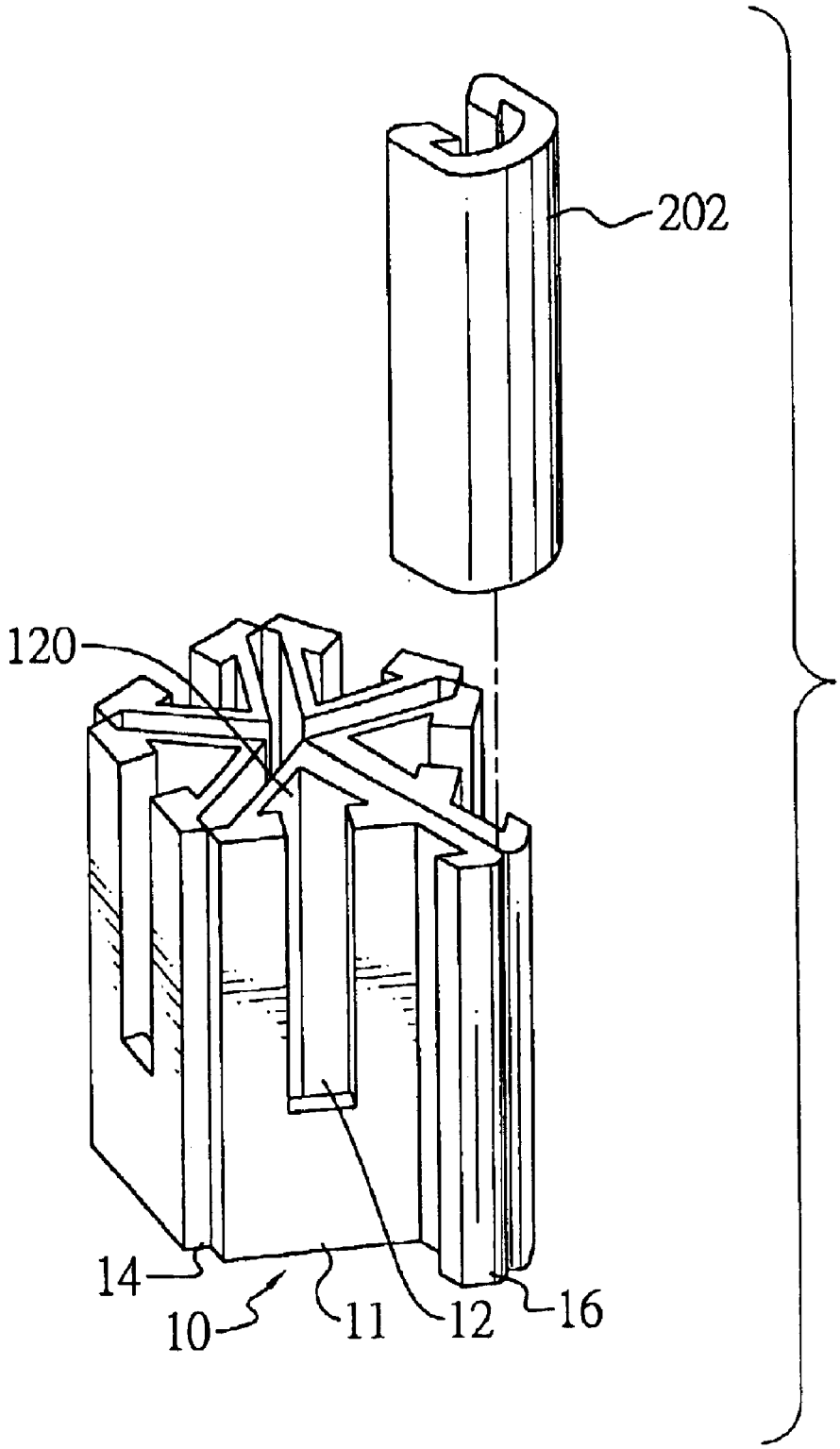
FIG. 2 is an exploded perspective view of the first embodiment of the inventive connector.

Referring to FIG. 2, a clasp (202) is provided for releasably joining the lips (16) and hence the ends of the band (10) together.

In the first embodiment, the clasp (202), made separately from the band (10), is configured into a resilient slit tube that has a pair of hooked edges adapted to snap over and engage with the hooked lips (16) of the looped band (10), thereby releasably joining the lips (16) together and keeping the band (10) in the looped position.

Figure 3:
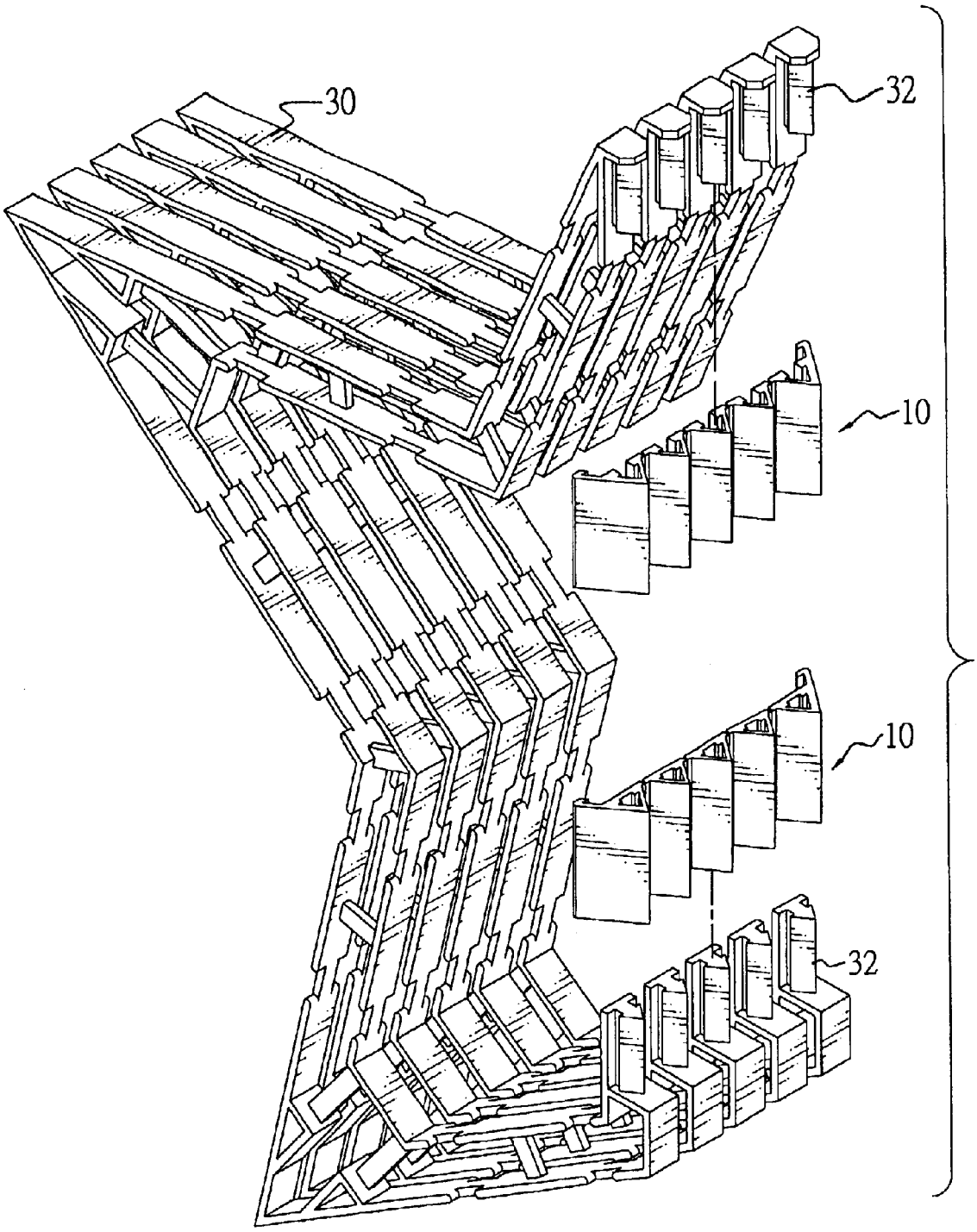
FIG. 3 is a perspective view showing a plurality of decorative lamp racks to be connected together by the connectors of FIG. 2.

Referring to FIG. 3, the inventive connector is used for connecting a plurality of separated racks (30), which may each be shaped as half a five-pointed star as illustrated. The racks (30), arranged side by side, have respective upper and lower legs (32) to be held in elements (11) of two bands (10).

The racks (30) are connected together by inserting their legs (32) into the holes (120) and slots (12) in the elements (11) of the bands (10). The racks (30) are then interconnected by the two bands (10), as shown in FIG. 4.

Figure 4:
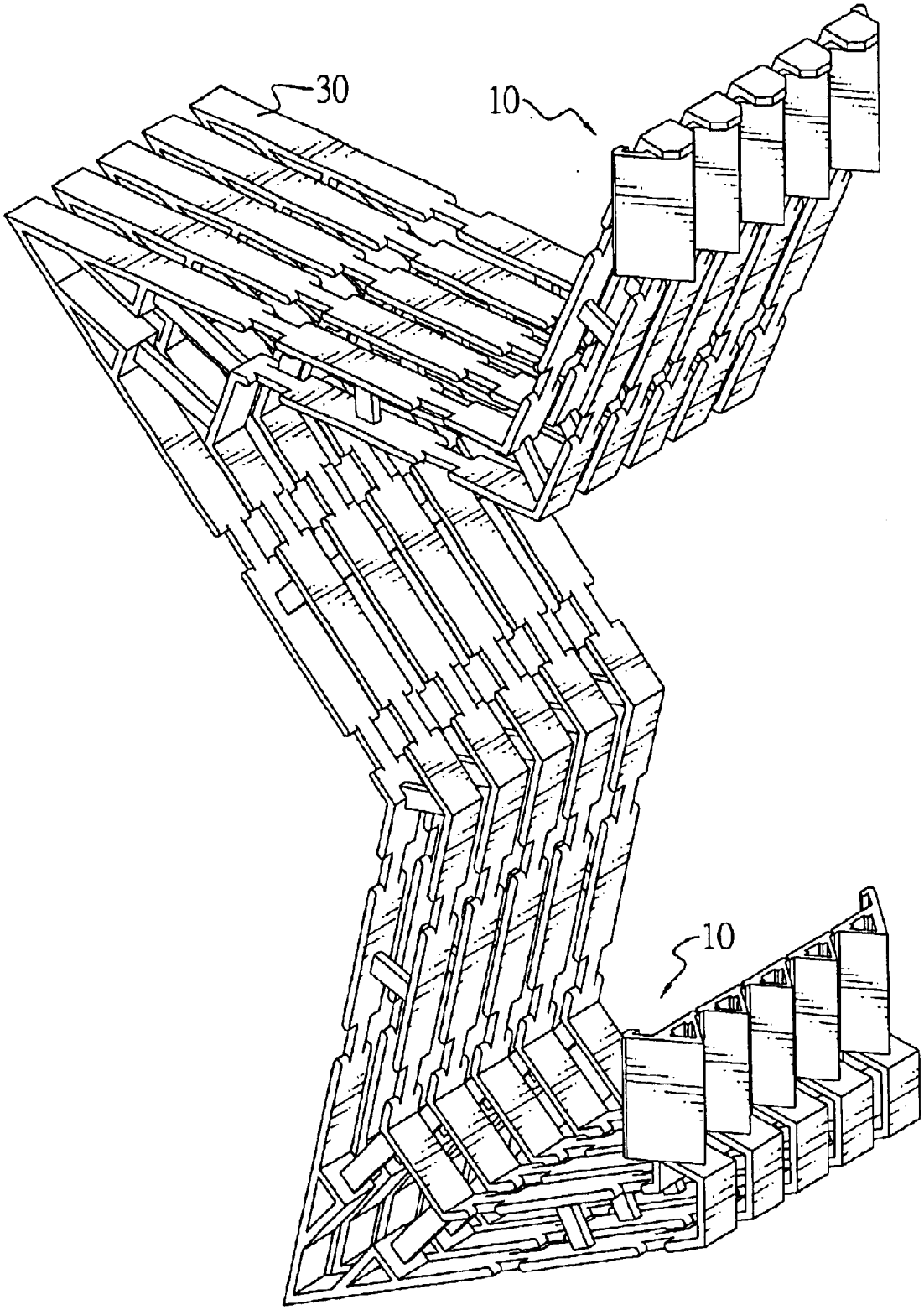
FIG. 4 is a perspective view showing the decorative lamp racks connected together by the connectors of FIG. 2.

Referring to FIG. 4, the interconnected racks (30) are now got ready to be unfolded. As the bands (10) are being looped, the racks (30) are turned one relative to another and finally configured into a common frame, as best shown in FIG. 5.

Figure 5:
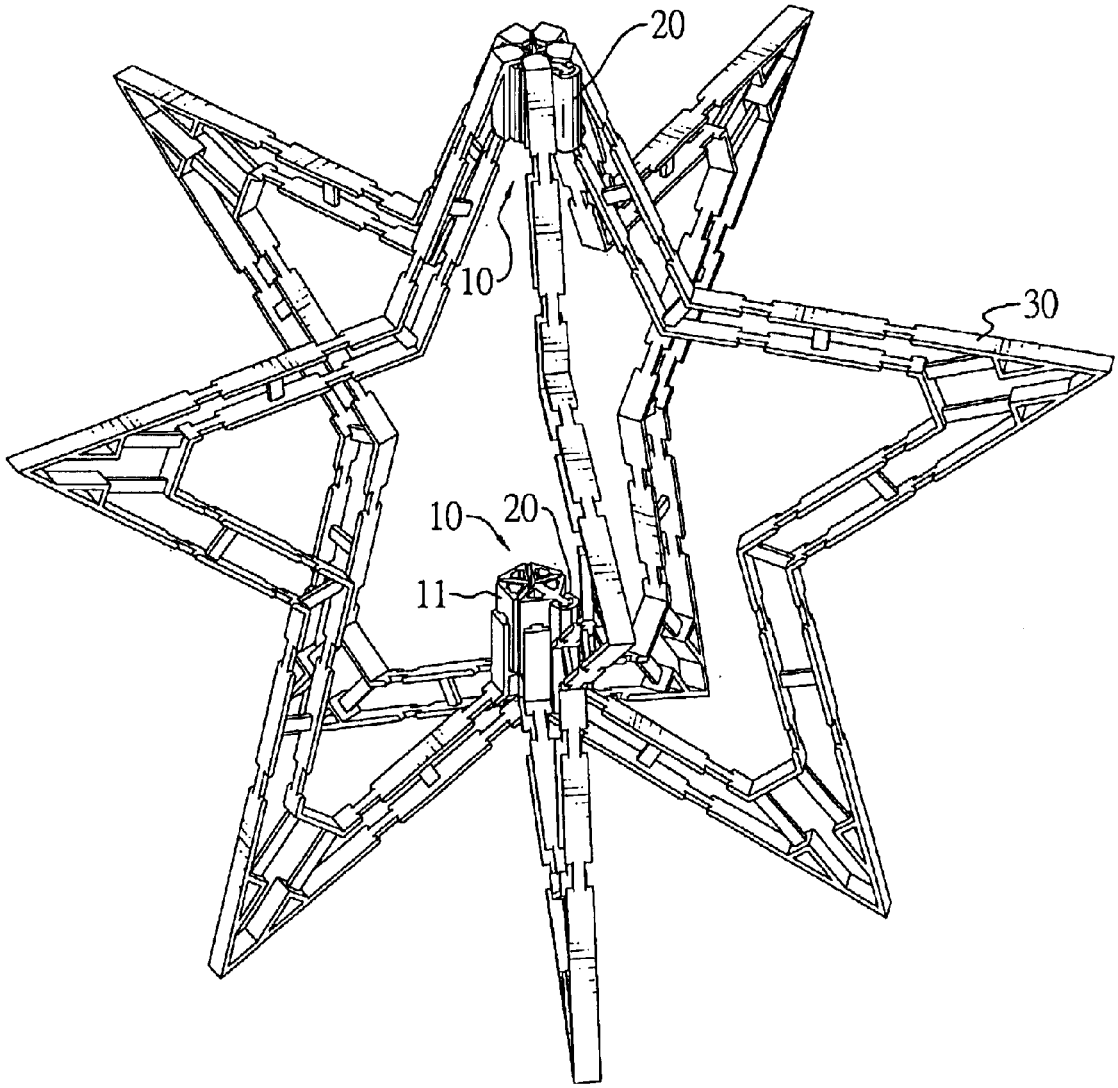
FIG. 5 is a perspective view showing the decorative lamp racks being folded to form a stable frame.

Referring to FIG. 5, the frame is kept in this spatial configuration as soon as two clasps (20) are snapped onto the looped bands (10). The racks (30) are now arranged uniformly with predetermined angles between them, as viewed from above. This makes the frame stable enough to stand on a bearing surface, such as the ground.

Such arrangement of the racks (30) also presents a number of spatial patterns, for example, spatial five-point stars as illustrated. These spatial patterns are attractive and fantastic because they vary depending on the point from which they are viewed.

Figure 6:
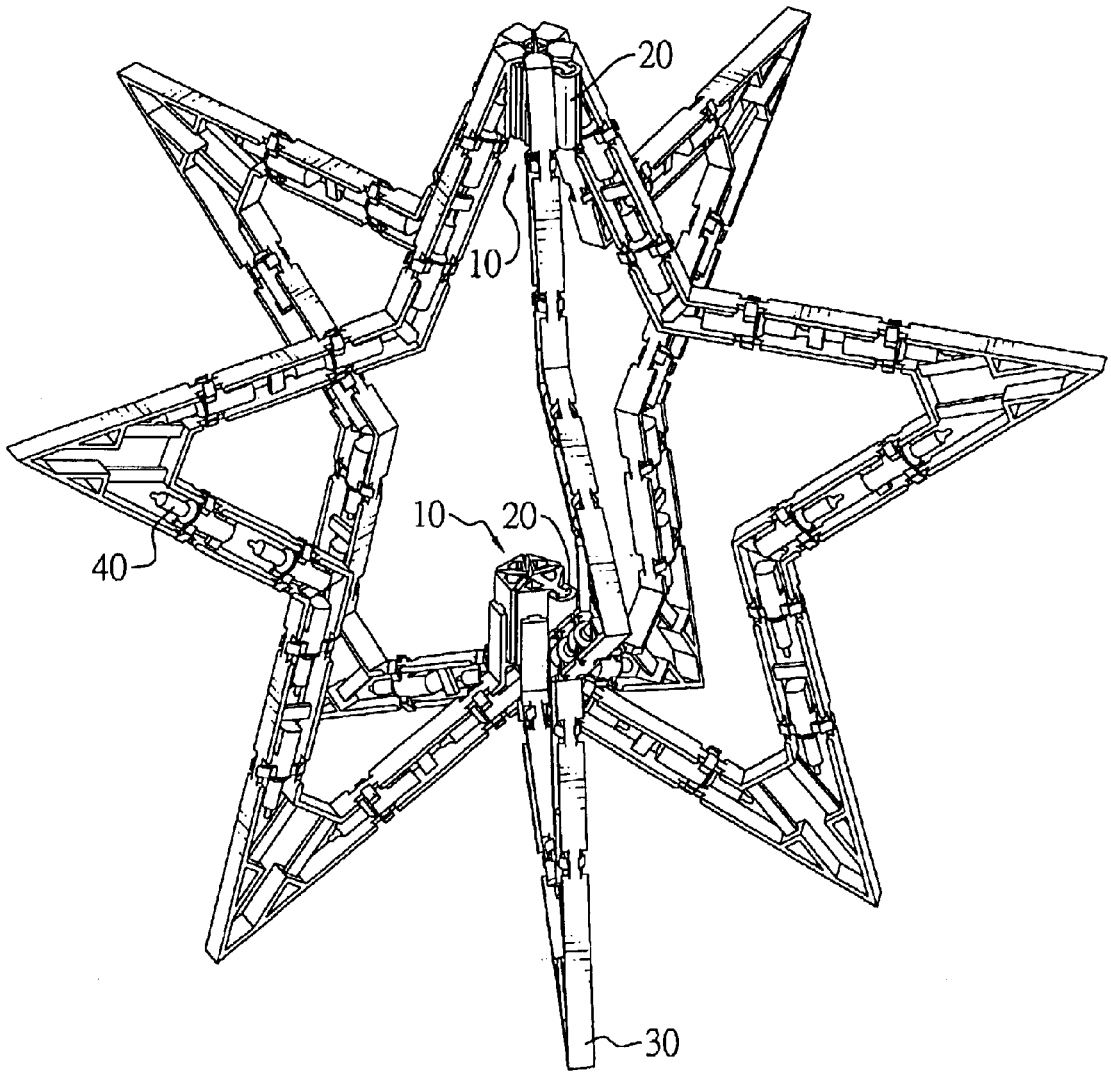
FIG. 6 is a perspective view showing a plurality of decorative lamps arranged on the frame of FIG. 5.

Referring to FIG. 6, a plurality of decorative lamps (40) then may be arranged along the rack (30), taking the shape of the attractive and fantastic patterns. The glowing or sparkling of the lamps (40) in these patterns, especially in the dark, will surely bring people to the climax of enjoyment at Christmas Eve.

Figure 7:
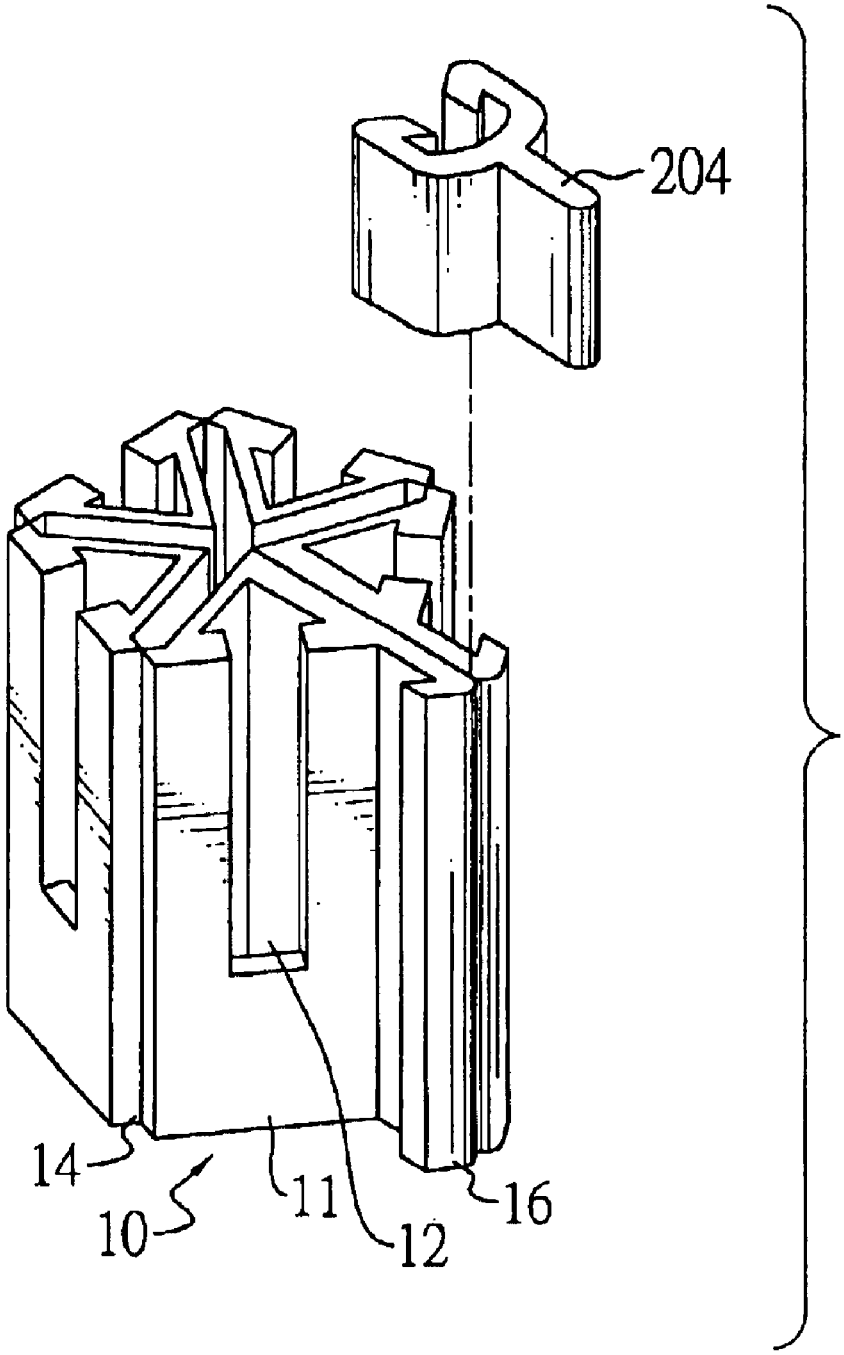
FIG. 7 is an exploded perspective view of a second embodiment of the inventive connector.

Referring to FIG. 7, a second preferred embodiment of the inventive connector includes a band (10) similar to the first embodiment, and a clasp (204) configured into a resilient forked body that has a pair of hooked branches adapted to snap over and engage with hooked lips (16) of the looped band (10).

The resilient forked body has an additional handle, which is provided for being held with the hand to push the clasp (204) until its hooked branches are snapped onto the hooked lips (16) of the looped band (10).

Figure 8:
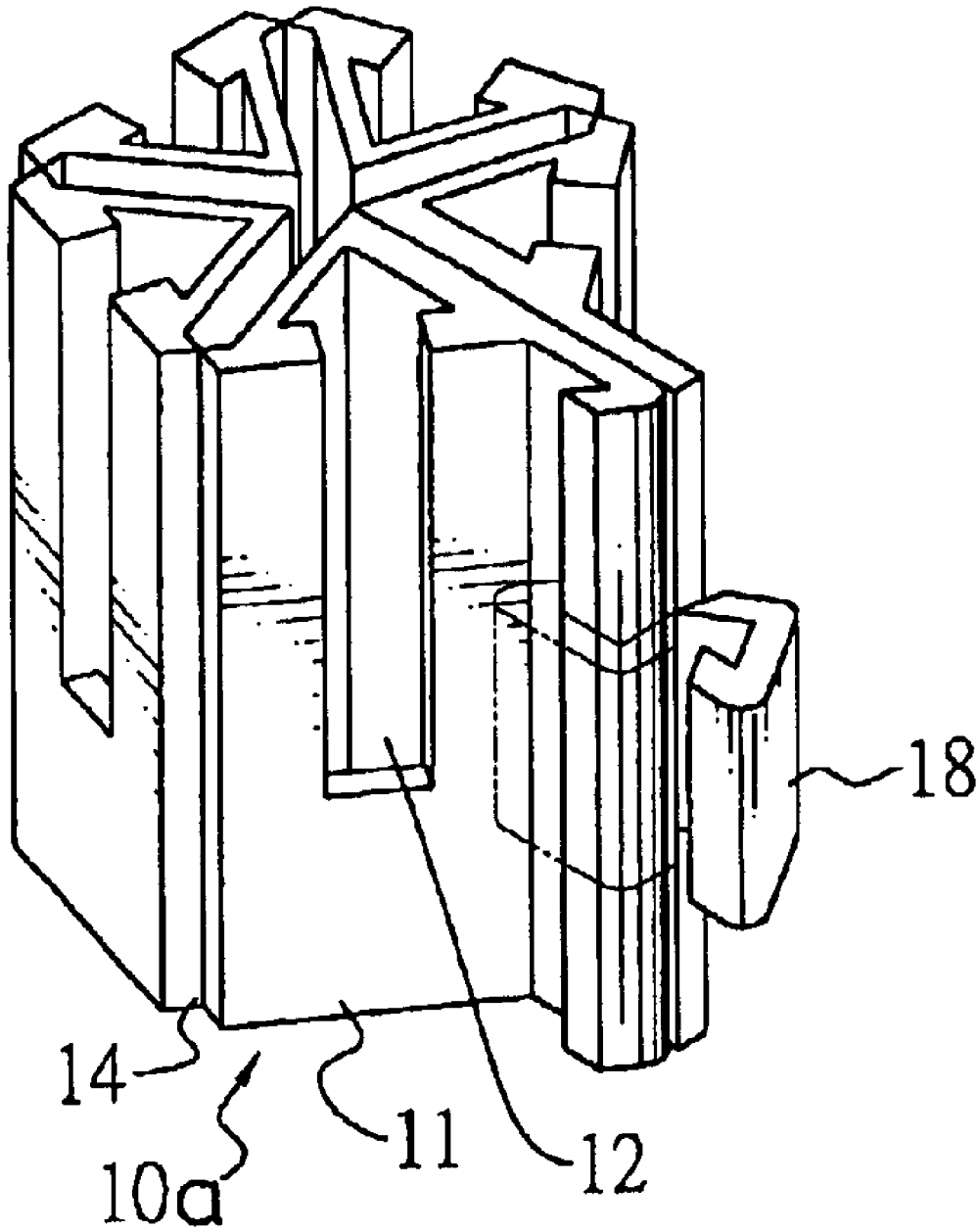
FIG. 8 is an exploded perspective view of a third embodiment of the inventive connector.

Referring to FIG. 8, a third preferred embodiment of the inventive connector is shown now. In this embodiment, the connector includes a band (10*a*) having a first end formed with a hooked lip (16) and a second end integrally formed with a clasp (18).

The clasp (18), also hooked in shape, is resiliently flexible so as to snap over and engage with the hooked lip (16) of the looped band (10*a*), thus releasably joining the ends of the band (10*a*) together. It is apparent that the integral formation of the clasp (18) with the band (10*a*) allows the ends of the same band (10*a*) to be joined easily and quickly.

Figure 9:
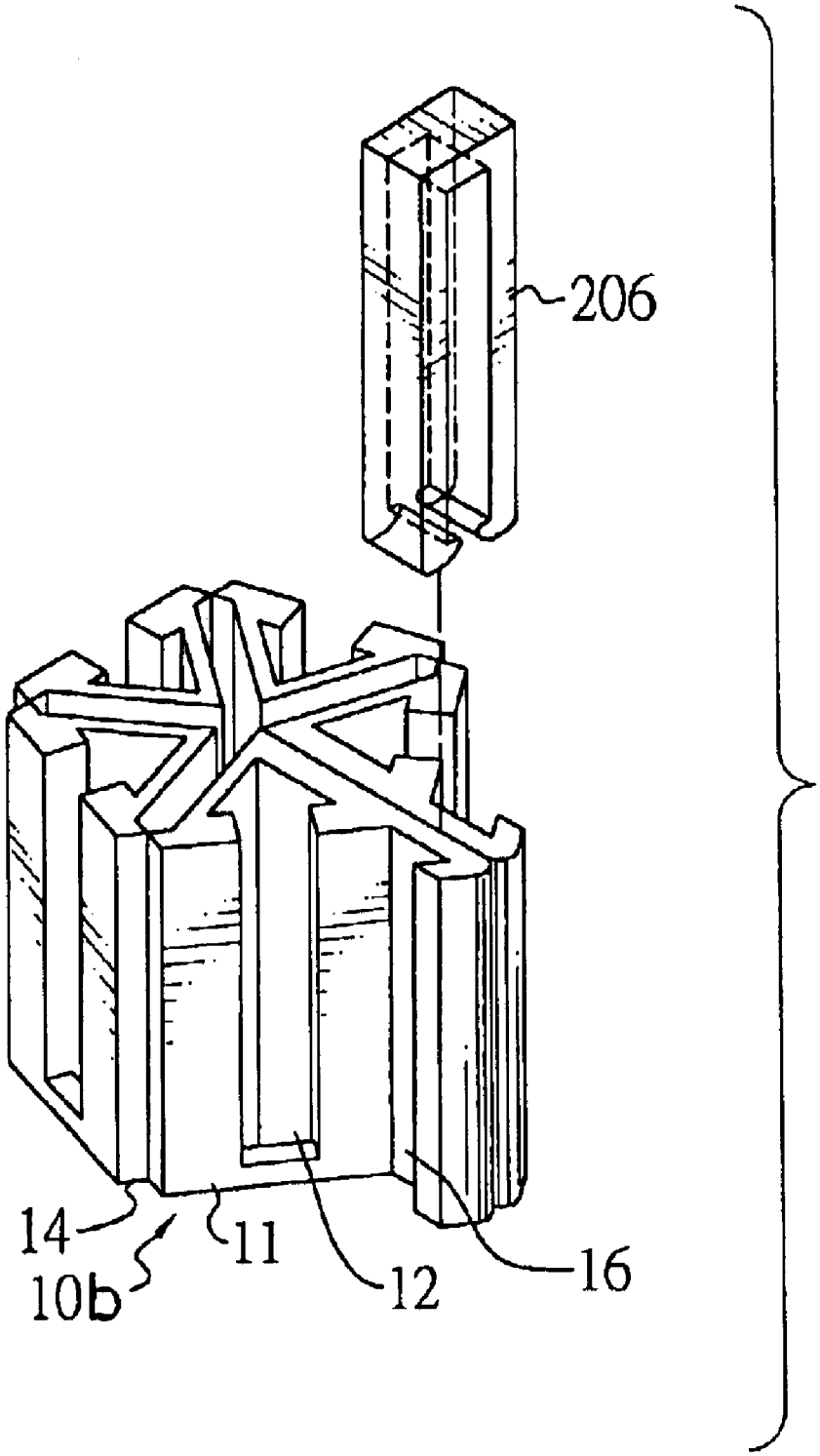
FIG. 9 is an exploded perspective view of a fourth embodiment of the inventive connector.

Referring to FIG. 9, a fourth preferred embodiment of the inventive connector is shown. In addition to a band (10*b*) similar to the first embodiment, the connector here includes a clasp (206) configured into a resilient U-shaped body that has a pair of hooked ends adapted to snap over and engage with necks of the hooked lips (16) of looped the band (10*b*). Thus, the clasp (206) can also releasably join ends of the band (10*b*) together.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector for decorative lamp racks (30), comprising a band (10, 10*a*, 10*b*) having a plurality of adjoined elements (11), each of said elements (11) having at least one edge (14) flexibly connected to adjacent one of said elements (11), each of said elements (11) having a hole (120) formed in an end thereof, and at least one hooked lip (16) extending from a first of two ends of said band, said band (10, 10*a*, 10*b*) being provided with a clasp (202, 204, 18, 206) for releasably joining said at least one hooked lip (16) and a second end of said band (10, 10*a*, 10*b*) together after said band (10, 10*a*, 10*b*) has been looped.

2. The connector as claimed in claim 1, wherein said band (10, 10*a*, 10*b*) has an outer side and an indented inner side.

3. The connector as claimed in claim 2, wherein each of said elements (11) is shaped into a triangular prism on said indented inner side.

4. The connector as claimed in claim 2, wherein each of said elements (11) is shaped into a truncated triangular prism on said indented inner side.

5. The connector as claimed in claim 2, wherein said hole (120) in each of said elements (11) has a slot portion (12) defined in said outer side of said band (10, 10*a*, 10*b*).

6. The connector as claimed in claim 1, wherein said clasp (202, 204, 206) is made separately from said band (10, 10*b*).

7. The connector for decorative lamp racks (30), comprising a band (10, 10*a*, 10*b*) having a plurality of adjoined elements (11), each of said elements (11) having at least one edge (14) flexibly connected to adjacent one of said elements (11), each of said elements (11) having a hole (120) formed in an end thereof, and said band (10, 10*a*, 10*b*)being provided with a clasp (202, 204, 18, 206) for releasably joining ends of said band (10, 10*a*, 10*b*) together after said band (10, 10*a*, 10*b*)has been looped, said clasp (202, 204, 206) being made separately from said band (10, 10*b*), said band (10, 10*b*) has having a pair of hooked lips (16) extending from said ends thereof, and wherein said clasp (202, 204, 206) is adapted to snap over and engage with said hooked lips (16) after said band (10, 10*b*) having been looped, thereby releasably joining ends of said band (10, 10*b*) together.

8. The connector as claimed in claim 7, wherein said clasp (202) is configured into a resilient slit tube, and wherein said resilient slit tube has a pair of hooked edges adapted to snap over and engage with said hooked lips (16) after said band (10) having been looped, thereby releasably joining ends of said band (10) together.

9. The connector as claimed in claim 7, wherein said clasp (204) is configured in a resilient forked body, and wherein said resilient forked body has a handle and a pair of hooked branches adapted to snap over and engage with said hooked lips (16) after said band (10) having been looped, thereby releasably joining ends of said band (10) together.

10. The connector as claimed in claim 7, wherein said clasp (206) is configured into a resilient U-shaped body, and wherein said U-shaped body has a pair of hooked ends adapted to snap over and engage with necks of said hooked lips (16) of said band (10*b*).

11. A connector for decorative lamp racks (30), comprising a band (10, 10*a*, 10*b*) having a plurality of adjoined elements (11), each of said elements (11) having at least one edge (14) flexibly connected to an adjacent one of said elements (11), each of said elements (11) having a hole (120) formed in an end thereof, and said band (10, 10*a*, 10*b*) being provided with a clasp (202, 204, 18, 206) for releasably joining ends of said band (10, 10*a*, 10*b*) together after said band (10, 10*a*, 10*b*)has been looped, said band (10*a*) having a first end formed with a hooked lip (16) and a second end integrally formed with said clasp (18), wherein said clasp (18) is resiliently flexible so as to snap over and engage with said hooked lip (16), thereby releasably joining said ends of said band (10*a*) together.

* * * * *